US005640758A

United States Patent [19]

Roessler et al.

[11] Patent Number: 5,640,758

[45] Date of Patent: Jun. 24, 1997

[54] COMPONENT FEEDER WITH RECIPROCAL AND ROTATABLE MAGAZINE

[75] Inventors: Andreas Roessler, Milford, Conn.; Norbert Tessarsch, Giessen; Harald Knetsch, Herborn/Seelbach, both of Germany

[73] Assignee: Emhart Inc., Newark, Del.

[21] Appl. No.: 421,589

[22] Filed: Apr. 12, 1995

[51] Int. Cl.[6] ..... B23Q 7/10

[52] U.S. Cl. ..... 29/812.5; 29/243.521; 227/107; 221/265

[58] Field of Search ..... 29/811.2, 812.5, 29/813, 243.525, 203.521, 243.523; 227/107, 110, 117, 114; 221/256, 265, 277, 224

[56] References Cited

U.S. PATENT DOCUMENTS

| | | | |
|---|---|---|---|
| 3,561,641 | 2/1971 | Kerr, Jr. | 221/224 |
| 3,750,257 | 8/1973 | Berecz | 29/813 |
| 3,971,421 | 7/1976 | Damratowski | 29/813 X |
| 4,604,889 | 8/1986 | Sukharevsky | 29/812.5 |
| 4,662,206 | 5/1987 | Mauer et al. | 29/812.5 |
| 5,098,003 | 3/1992 | Young et al. | 227/117 X |

FOREIGN PATENT DOCUMENTS

| | | | |
|---|---|---|---|
| 0352623 | 7/1989 | European Pat. Off. . | |
| 40-091338 | 4/1994 | Japan | 29/812.5 |

*Primary Examiner*—Peter Vo
*Assistant Examiner*—Khan Nguyen
*Attorney, Agent, or Firm*—E. D. Murphy

[57] ABSTRACT

A component installation tool of the type having a rearward stroke to accommodate delivery of a component to the front of the tool and a forward stroke to engage, deliver and install the component at a workpiece, the tool including a housing, a reciprocating mechanism contained therein, a feeder support mounted on the housing, a reciprocal magazine mounted on the feeder support for reciprocation between a component receiving position adjacent the tool and a position for delivering a component in front of the mechanism; and delivery means for delivering a component to a chamber in the magazine when the magazine is in the component receiving position and the mechanism is in the forward stroke.

5 Claims, 3 Drawing Sheets

COMPONENT FEEDER WITH RECIPROCAL AND ROTATABLE MAGAZINE

BACKGROUND OF THE INVENTION

This invention is concerned with a fastener-installing tool comprising presenting means (e.g. a nosepiece) for receiving an elongated fastener element (e.g. a blind-riveting assembly or a weld stud) and holding it with one end exposed for presentation to a workpiece, the presenting means being mounted for axial reciprocation between fastener-receiving and fastener-installing positions, and delivery means by which fasteners are conveyed from a delivery end of a supply source to said presenting means when retracted to its fastener-receiving position.

The installation of fasteners such as blind-riveting assemblies and weld studs, or other fasteners which have cylindrical shanks with radially projecting flanges, must be presented to the workpiece by means, e.g. of a nosepiece, which closely embraces the shank. It is often also desirable that such means surrounds the shank completely, or as completely as possible, especially if the means, as is the case with a nosepiece in blind riveting, is going to apply pressure to the flange of the fastener.

Various feeding mechanisms for riveting tools have been proposed which are subject to problems of cost, complexity and reliability, and size. The system described in U.S. Pat. No. 4,662,206 overcomes several of these problems, but even this system is larger than desirable. Also, it is subject to the need to stop the setting operation while a new rivet is delivered from a remote supply to the nosepiece of the tool.

OBJECTS OF THE INVENTION

It is among the objects of this invention to provide a feeding mechanism for a fastener-installing tool which is smaller in size and more reliable than previous designs.

It is another object to provide an efficient feeding mechanism which permits faster tool operation than previous designs.

It is a further object to provide a fastener feeder which can be adapted to a variety of fastener shapes such as blind rivets, studs or nuts as well as various plastic clips.

BRIEF DESCRIPTION OF THE INVENTION

This invention relates to an improved feeder for use in a fastener-installing tool comprising presenting means (e.g., a nosepiece) for receiving an elongated fastener element (e.g., a blind-riveting assembly or a weld stud) and holding it with one end exposed for presentation to a workpiece, the presenting means being mounted for axial reciprocation between fastener-receiving and fastener-installing positions, and a feeder by which fasteners are conveyed from a delivery end of a supply source to said presenting means when retracted to its fastener-receiving position, characterized in that the feeder comprises a rotary magazine movable between a first position wherein one chamber is aligned with the delivery end of the supply source and a second position wherein said one chamber is aligned with the presenting means, the magazine being rotatably moved back to the first position by the presenting means as it acquires the rivet and returns to its fastener-installing position, the rotation of the magazine effecting alignment of a second chamber with the delivery end of the supply source. The following description of an illustrative arrangement has been selected for description by way of example and not of limitation of the invention.

DESCRIPTION OF THE PREFERRED EMBODIMENT

While this invention will be described with particular reference to a rivet setting tool, the feeder described is equally applicable to stud welding equipment where it may be used to deliver studs to the front end of a stud welding gun which then applies and welds these studs to a workpiece. The advantages of this invention are also particularly suited to the stud welding operation.

Figure 1:
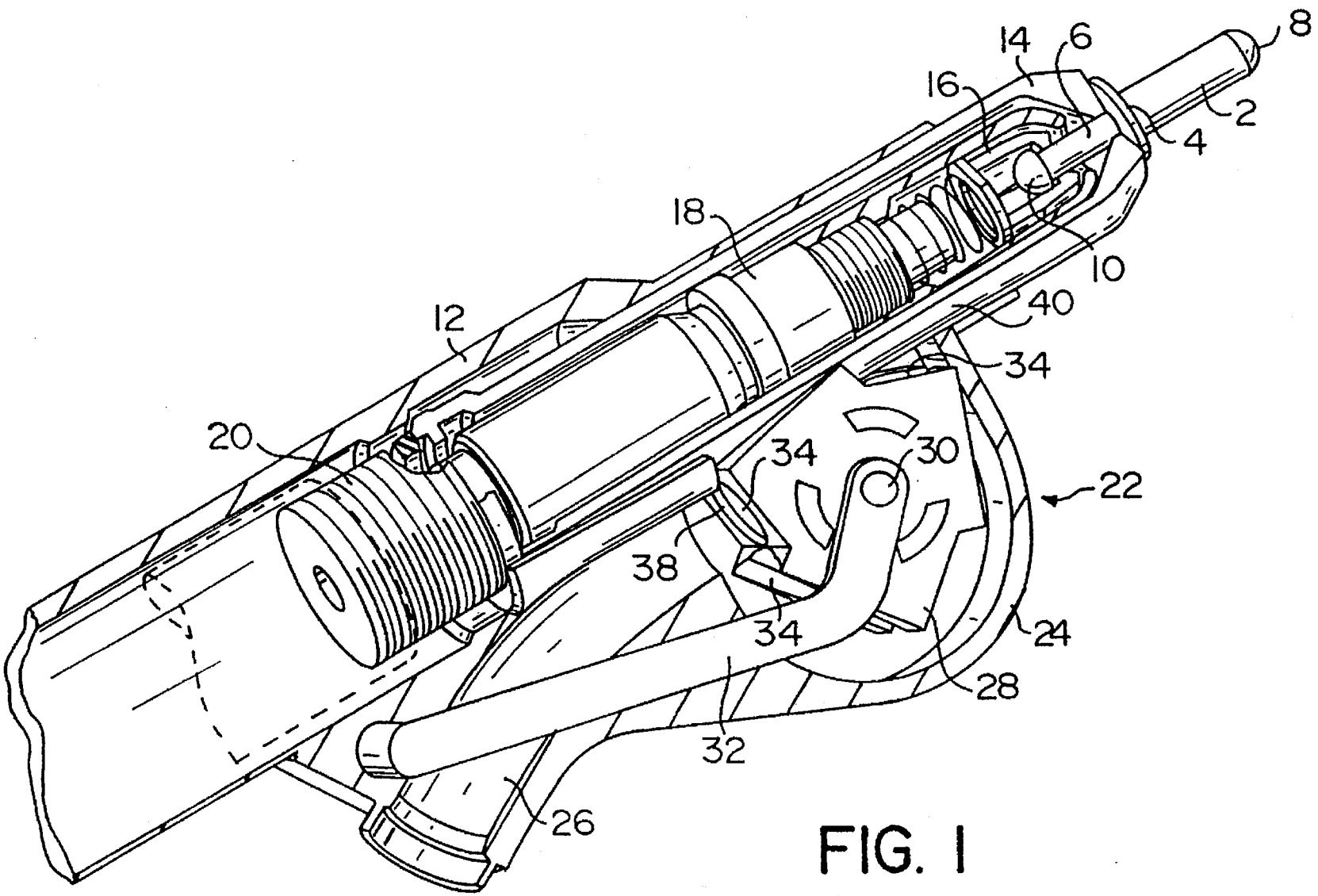
FIG. 1 is a simplified view partially cut away of a front end portion of an exemplary embodiment of a tool in accordance with the invention showing the presenting means in its fastener-setting position and the feeder in its first position.

FIG. 1 illustrates a rivet presentation and setting apparatus of a type particularly designed for setting a double headed rivet which includes a rivet body 2, a head or flange 4 and a mandrel 6. The mandrel includes a first, setting head at the opposite end of the rivet body from the flange 4 for expanding the rivet body when the mandrel is pulled and a pulling head 10. The presentation and setting apparatus is described in particular detail in U.S. Pat. No. 5,519,927, issued May 28, 1996. This apparatus includes a housing 12 which is connected to a tool body, not shown, which includes a suitable reciprocating hydraulic piston and appropriate controls therefor. Within the housing 12, a plurality of supporting segments 14 are provided for restraining the rivet flange 14 when the mandrel head 10 is pulled by pulling segments 16 which engage the reverse surface of the mandrel head 10 at the front end of a collet assembly 18. The collet assembly is suitably coupled at its rear end to the hydraulic piston, for example by threads 20 at an angular separation corresponding to the rotation of the magazine produced by the movement of the collet assembly. Means are also provided in the tool for removing the broken off mandrel through a hollow tube which runs through the center of the collet assembly as is well known in this art. In the illustration of FIG. 1, the presentation and setting apparatus is in its forward-most position with a rivet gripped in the pulling jaws and ready to be presented. to and set in a workpiece, also not shown.

FIG. 1 also illustrates a feeder 22 in particular accord with the present invention. The feeder is positioned within an extension 24 of housing 12 which also contains the delivery end 26 of a supply tube through which rivets are delivered from a remote source. The feeder 22 comprises a rotary magazine 28 which is mounted for rotation on an axis 30 at the end of a pivot arm 32 which is mounted at a rearward location in the housing extension 24.

The magazine 28 comprises a plurality of chambers 34, three being illustrated in the preferred embodiment although two or more may be used if desired. Each chamber comprises an open-topped socket 36 for receiving the rivet body 2 and mandrel head 8 and a semicircular seat 38 for receiving flange 4.

In accord with a particular feature of the present invention, a significant increase in the efficiency and speed of operation of the tool is achieved by virtue of the fact that the chamber 34 is positioned in alignment with the end of the delivery tube 26 during the time that the presentation and setting apparatus presents and sets the rivet 2 in a workpiece. Thus, by the time a setting operation is complete and the broken mandrel is being withdrawn, the next rivet is available in the magazine 28 and is available for delivery at the front of the rivet tool as soon as the collet assembly and support segments are sufficiently retracted.

Figure 2:
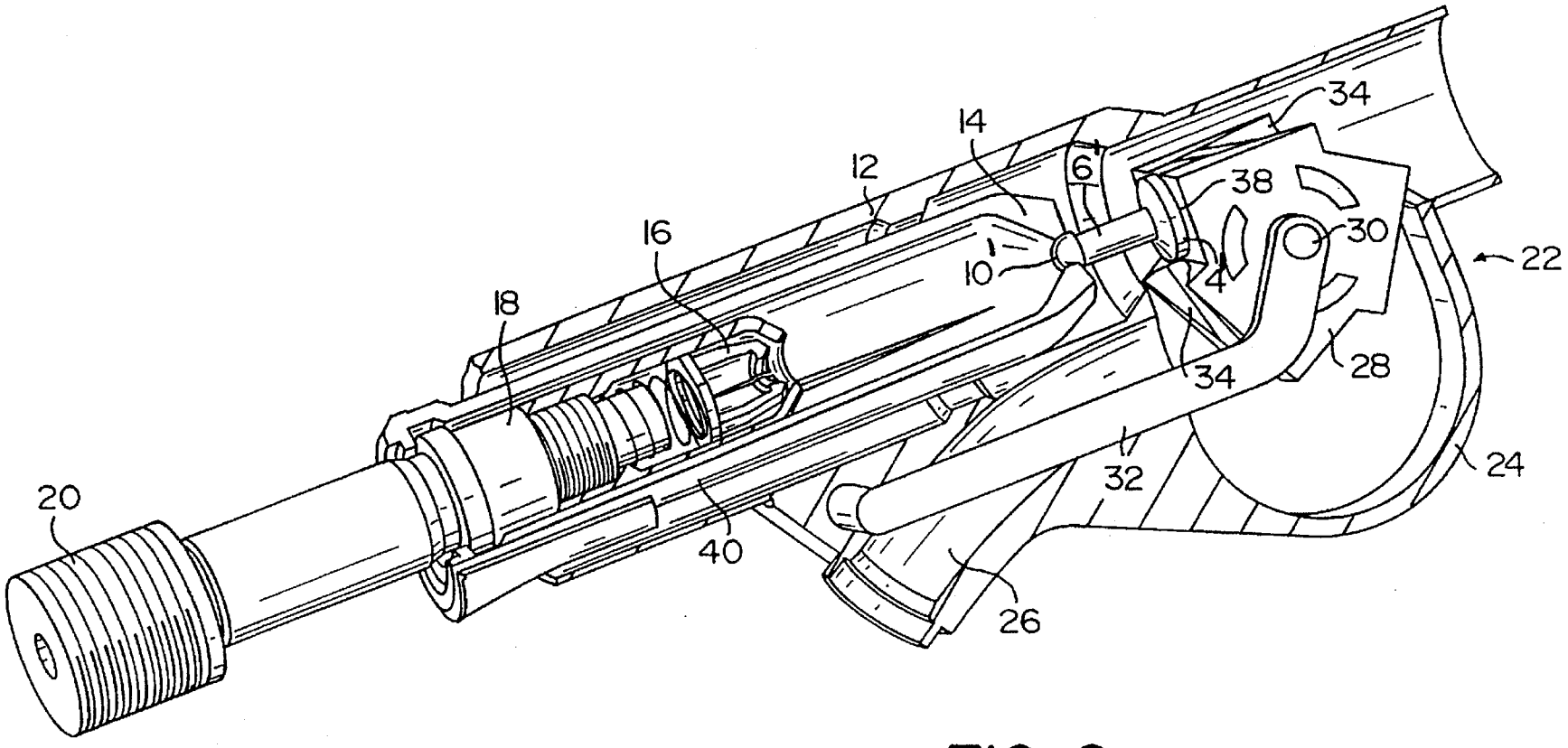
FIG. 2 is a view similar to FIG. 1 but showing the presenting means in its fastener-receiving position and the feeder in its second position.
Figure 3:
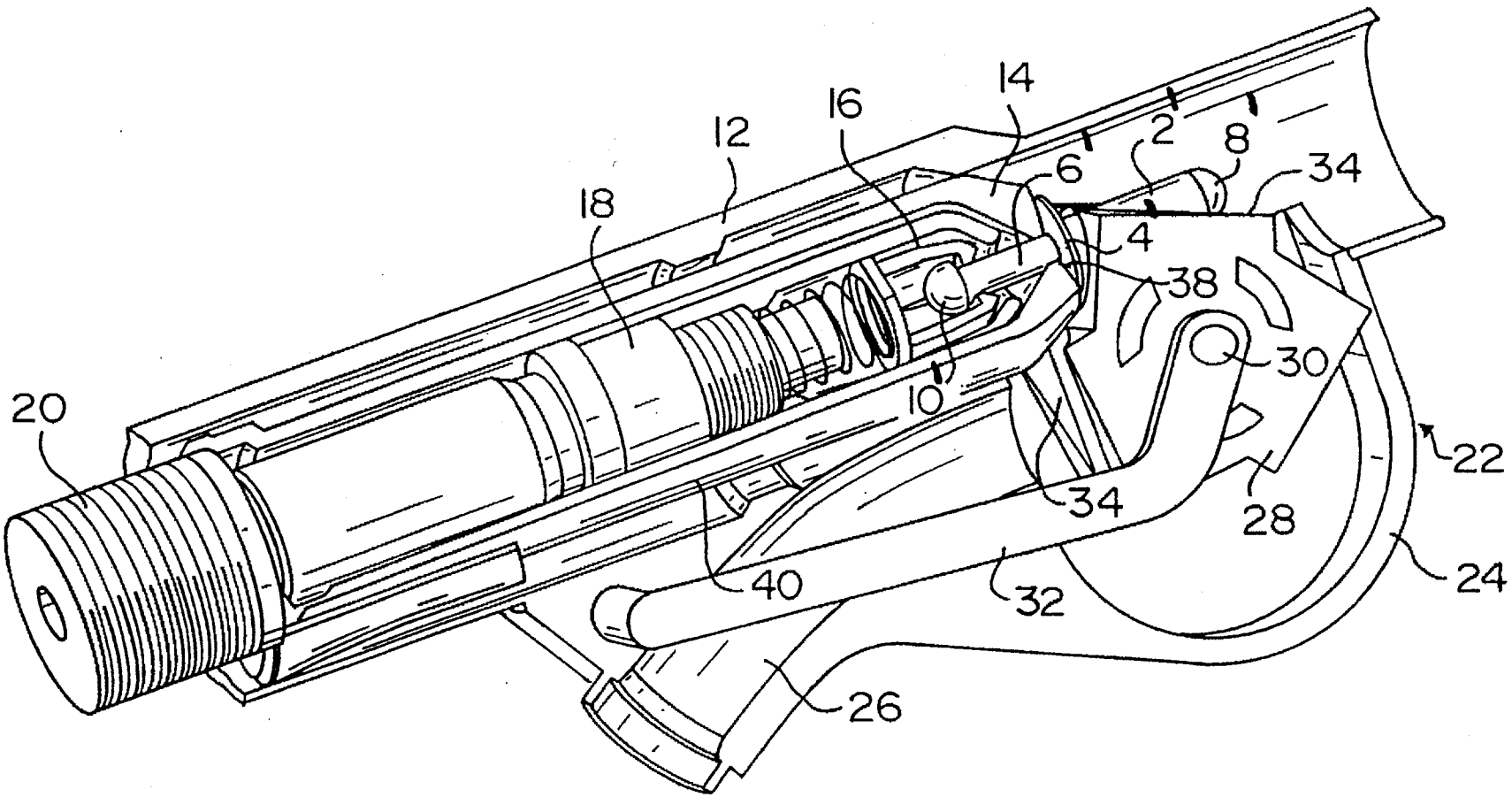
FIG. 3 is a similar view showing the presenting means being moved to its setting position and the feeder being moved to its first position.

FIG. 2 shows the mechanism of FIG. 1 except that the collet assembly and support segments have been retracted fully into the tool, clearing the interior of the housing 12. The pivot arm 32 has been operated to move the magazine 28 through a slot 40 in the side of housing 12 which carries a new rivet 2' into a loading position immediately in front of the support segments 14. As the motion of the hydraulic piston of the tool reverses, the collet assembly and support segments are now driven forward and the support segments pass over the mandrel head 10' until they engage the rivet flange 4. At this point, as described in the above-identified co-pending application, the collet assembly 18 moves forward relative to the support segments until the pulling segments 16 open, receive and engage the head 10'. As the collet assembly 18 continues to move forward, the coupling member 20 engages the rear end of the support segments 14 which in turn apply pressure through the rivet flange 4' on the seat 38 of chamber 34. As illustrated by FIG. 3, the magazine now begins to rotate on its axis and pivot arm 32 begins to pivot, lowering the magazine out of the path of the support jaws. Since the rivet is held by its head 10' and mandrel 6', the rivet will remain aligned with the support segments and pulling segments as the magazine 28 pivots and rotates out from under it.

FIG. 3 shows a further stage of this operation. In this view, the magazine has been pivoted nearly out of the housing 12 and the rivet is being carried forward through the housing 12 by the support and pulling segments. Continued motion returns the apparatus to the position illustrated in FIG. 1 where the rivet is ready for presentation and setting in a workpiece. At the same time, the magazine has been rotated to present another chamber 34 for receipt of the next rivet from the supply tube.

While this invention has been described in terms of a specific embodiment, it will be clearly understood that reasonable variations are meant to be included within the scope of the appended claims. For example, control of the pivot arm 32 may be exerted automatically by means of a spring so that it moves into the housing 12 as soon as the support segments 14 move out of the way or a positive hydraulic control may be incorporated into the tool operating mechanism. In another variation, the rotary magazine may have its axis mounted in a slot oriented perpendicularly to the axis of movement of the collet assembly so that, as the magazine rotates in delivering a rivet, the axis moves vertically down the slot, carrying the magazine out of the housing. When the support segments 14 again move out of the way, a spring or control device returns the magazine into the housing carrying the next rivet in the next chamber.

The appended claims are intended to include all such variations and modifications as may fall within the spirit and scope of this invention. For example, by suitable modification of the shape of the receiving chamber, the feeder of this invention can easily be adapted for use with a wide variety of fasteners of differing shapes, both elongated and otherwise.

We claim:

1. In a component installation tool of the type having a rearward stroke to accommodate delivery of a component to the front of the tool and a forward stroke to engage, deliver and install the component at a workpiece, said tool comprising a housing, a reciprocating mechanism contained therein, and a feeder support mounted on said housing, the improvement comprising a reciprocal and rotatable magazine mounted on said feeder support for reciprocation between a component receiving position adjacent said tool and a position for delivering a component in front of said mechanism; said magazine having a plurality of component-receiving chambers spaced apart from one another and disposed around its circumference thereof and delivery means for delivering a component to one of said plurality of chambers in said magazine when said magazine is in said component receiving position and said mechanism is in said forward stroke.

2. A feeder for providing a supply of fasteners to a fastener installation tool which reciprocates along a path to successively engage a fastener, deliver the fastener to a workpiece, install the fastener thereon, and retract therefrom, said feeder comprising:

a feeder support disposed at the front of the fastener installation tool;

a magazine, said magazine having a plurality of receiving chambers, each of said receiving chambers being shaped to receive a fastener and having an outwardly facing opening to permit radial removal of the fastener therefrom;

means rotatably mounting said magazine on said feeder support;

a fastener delivery tube positioned to deliver fasteners to sequential ones of said receiving chambers as said magazine is rotated; and means for reciprocating said magazine into the path of the fastener installation tool when the fastener installation tool is retracted;

said rotatable mounting means and said reciprocating means permitting said magazine to be rotatably moved out of the fastener installation tool path during delivery of the fastener.

3. A feeder as claimed in claim 1 wherein said chambers are spaced around said magazine at an angular separation corresponding to the rotation of the magazine produced by the tool movement.

4. A feeder as claimed in claim 2 wherein said reciprocating means comprises a pivot arm rotatably mounted on said feeder support and supporting said magazine.

5. A feeder as claimed in claim 2 wherein said chamber is shaped to receive the fastener from said tube in position to be engaged by the installation tool.

* * * * *